United States Patent [19]

Morgan

[11] Patent Number: 5,070,825

[45] Date of Patent: Dec. 10, 1991

[54] ROTATING PISTON DIESEL ENGINE

[76] Inventor: Edward H. Morgan, 117 E. 51st St., Savannah, Ga. 31405

[21] Appl. No.: 476,933

[22] Filed: Feb. 8, 1990

[51] Int. Cl.[5] ..... F02B 57/00

[52] U.S. Cl. ..... 123/43 A; 123/43 AA; 123/44 C; 123/65 VC

[58] Field of Search ..... 123/43 A, 43 AA, 65 VC, 123/44 C, 43 R

[56] References Cited

U.S. PATENT DOCUMENTS

| | | | |
|---|---|---|---|
| Re. 30,565 | 4/1981 | Kristiansen | 123/43 AA |
| 2,329,480 | 9/1943 | Neuland | 123/53 |
| 2,556,585 | 6/1951 | Jarvinen | 123/43 |
| 3,007,462 | 11/1961 | Balzer | 123/58 |
| 3,034,490 | 5/1962 | Donaldson | 123/43 |
| 3,212,483 | 10/1965 | Balzer | 123/41.84 |
| 3,528,394 | 9/1970 | Cummings | 123/58 |
| 3,587,538 | 6/1971 | Poole | 123/45 |
| 3,654,906 | 4/1972 | Airas | 123/43 |
| 3,695,237 | 10/1972 | Londo | 123/43 A |
| 3,807,370 | 4/1974 | Baugh | 123/43 AA |
| 3,899,880 | 8/1975 | Rohs | 60/39.61 |
| 3,939,809 | 2/1976 | Rohs | 123/58 B |
| 3,945,359 | 3/1976 | Asaga | 123/58 R |
| 3,970,055 | 7/1976 | Long | 123/43 A |
| 3,973,531 | 8/1976 | Turner | 123/43 A |
| 4,060,060 | 11/1977 | Turner | 123/43 A |
| 4,157,079 | 6/1979 | Kristiansen | 123/43 AA |
| 4,169,436 | 10/1979 | Welch et al. | 123/58 BC |
| 4,307,695 | 12/1981 | Vasilantone | 123/559 |
| 4,366,786 | 1/1983 | Dunstan | 123/179 F |
| 4,497,284 | 2/1985 | Schramm | 123/41.47 |
| 4,523,549 | 6/1985 | Lacy | 123/58 BC |
| 4,620,475 | 11/1986 | Watts | 91/499 |
| 4,622,885 | 11/1986 | Schriwer | 91/499 |
| 4,624,175 | 11/1986 | Wahlmark | 91/487 |
| 4,779,579 | 10/1988 | Skuava et al. | 123/43 A |
| 4,960,082 | 10/1990 | Sullivan et al. | 123/43 A |

*Primary Examiner*—Richard A. Bertsch
*Assistant Examiner*—Michael I. Kocharov
*Attorney, Agent, or Firm*—Roland H. Shubert

[57] ABSTRACT

An internal combustion engine (20) has a plurality of pistons (106) reciprocating within cylinders (34) and means to translate the reciprocating motion of said pistons into rotary motion. As the cylinders (34) rotate in an engine cavity (49) about a drive shaft (24), head ends (104) of the cylinders (34) cyclically pass stationary fuel injection means (28) and a stationary exhaust aperture (30) located rotationally downstream from the fuel injection means (28). Each cylinder (34) includes a cylinder wall having an air intake port (130) provided therein. The air intake port (130) is provided at a location at which rotation of the cylinder (34) in the cavity (49) tends to force or scoop air into the cylinder (34). In particular, the air intake port (130) is provided on a rotationally leading portion of a peripheral portion of the cylinder wall. The air intake port (130) of the cylinder is opened after alignment with the exhaust port (30) has commenced but before the piston (106) in a chamber (34) reaches its extreme point of travel. As the air intake port (130) is thusly opened, ambient air from the engine cavity (49) is forced into the air intake port (130) by rotational motion of the cylinder (34). Thus, with the cylinder (34) registering with the exhaust port (30), the rotational motion of the cylinder (34) forces or scoops ambient air from the engine cavity (49) into the air intake port (130), through the interior or the cylinder (34), and through the exhaust aperture (30) for scavenging the cylinder assembly (34).

27 Claims, 6 Drawing Sheets

ROTATING PISTON DIESEL ENGINE

BACKGROUND

1. Field of the Invention

This invention pertains to internal combustion engines and methods of operating the same, particularly to rotating piston diesel engines.

2. Prior Art and Other Considerations

Internal combustion engines generally have a plurality of pistons reciprocating within cylinders. In one type of rotary engine, the cylinders are typically confined in a cylinder block which is rotated internally in an engine block about a drive shaft. A head end of the cylinders becomes cyclically aligned a fuel injecting or igniting device and an exhaust port. Such a rotary engine further has means for translating the reciprocating motion of said pistons into rotary motion. This motion translating means can be a device such as "wobble" plate (also known as a "swash" plate).

Examples of rotary engines of the type described above are provided in the following U.S. Pat. No. 3,939,809 Rohs; Rohs U.S. Pat. No. 3,899,880; Jarvinen U.S. Pat. No. 2,556,585; Airas U.S. Pat. No. 3,654,906; Balzer U.S. Pat. No. 3,212,483; Balzer U.S. Pat. No. 3,007,462; Long U.S. Pat. No. 3,970,055; Welch U.S. Pat. No. 4,169,436; Neuland U.S. Pat. No. 2,329,480; Donaldson U.S. Pat. No. 3,034,490; Vasilantone U.S. Pat. No. 4,307,695; Poole U.S. Pat. No. 3,587,538; Kristiansen U.S. Pat. No. 4,157,079; Lacy U.S. Pat. No. 4,523,546; Schramm U.S. Pat. No. 4,497,284; Dunstan U.S. Pat. No. 4,366,786; Asaga U.S. Pat. No. 3,945,359; Cummings U.S. Pat. No. 3,528,394; Schriwer U.S. Pat. No. 4,622,885; Skuava U.S. Pat. No. 4,779,579; Londo U.S. Pat. No. 3,695,237; Watts U.S. Pat. No. 4,620,475; and, Wahlmark U.S. Pat. No. 4,624,175.

In order to facilitate combustion, rotary engines of the type described above must also have means for introducing air into the cylinders. In this regard, for some rotary engines intake ports have been provided on a peripheral surface of a cylinder wall. In the prior art, these intake ports cyclically register with further air ports or an air manifold provided in the engine block in which the cylinders rotate. In order to provide sufficient pressure to force air through the engine block and into the aligned air intake ports of the cylinders, blower motors or turbo chargers are provided. The blower motors and/or turbo chargers are generally powered by the internal combustion engine itself.

Unfortunately, high pressure blower motors and turbo chargers as required in the prior art considerably drain the horsepower of the engine, often exacting up to 15 or 20 horsepower. Additionally, the inclusion of a separate piece of equipment such as a blower motor or turbo charger increases the weight of the engine and hence of the vehicle. Consequently, the efficiency of the engine is undesirably diminished.

In view of the foregoing, it is an object of this invention to provide an efficient rotating piston internal combustion engine and a method of operating the same.

An advantage of the present invention is the provision of a rotating piston internal combustion engine which obviates the need of high pressure blowers and turbo chargers.

Another advantage of the present invention is the provision of a rotating piston internal combustion engine having efficient air cooling features.

SUMMARY

An internal combustion engine has a plurality of pistons reciprocating within cylinders and means to translate the reciprocating motion of said pistons into rotary motion. AS the cylinders rotate in an engine cavity about a drive shaft, head ends of the cylinders cyclically pass stationary fuel injection means and a stationary exhaust port located rotationally downstream from the fuel injection means. Each cylinder includes a cylinder wall having an air intake port provided therein. The air intake port is provided at a location at which rotation of the cylinder in the cavity tends to force or scoop air into the cylinder. In particular, the air intake port is provided on a rotationally leading portion of a peripheral portion of the cylinder wall.

The fuel injection means and the exhaust port are provided in a stationary reference plate through which the rotating drive shaft extends. In abutting relationship with the stationary reference plate is a rotating plate which has head ends of the cylinders mounted thereon. The cylinders have major axes which are non-parallel with the drive shaft. That is, the major axes of the cylinders are angularly inclined with respect to the engine drive shaft. A second end of each cylinder connects to an oil pan. The oil pan is spaced downstream along the drive shaft from the rotating plate to form a cavity between the oil pan and the rotating plate. The cylinders rotate in this substantially unconfined engine cavity. The air intake ports of the cylinders do not register with openings or manifolds in an engine block or the like, but receive ambient air from the engine cavity existing between the oil pan and the rotating plate.

Two concentric circular seals are provided on the stationary reference plate. The fuel injection means and the exhaust port of the reference plate are located between the two concentric circular seals. Circular seals are also provided around a mouth of the combustion chamber of each cylinder. In the abutting relationship of the stationary reference plate and the rotating plate which carries the cylinders, the circular seals at the combustion chamber mouths are also located between the two concentric circular seals of the stationary reference plate. Accordingly, a tight sealing arrangement is provided.

In accordance with methods of the invention for operating the internal combustion engine, the air entry port of a cylinder is opened after alignment with the exhaust port has commenced but before the piston in a chamber reaches its extreme point of travel. As the air intake port is thusly opened, ambient air from the engine cavity is forced into the air intake port by rotational motion of the cylinder. With the cylinder registering with the exhaust port, the rotational motion of the cylinder forces or scoops ambient air from the engine cavity into the air intake port, through the interior of the cylinder, and through the exhaust aperture for scavenging the cylinder assembly.

BRIEF DESCRIPTION OF THE DRAWINGS

The foregoing and other objects, features, and advantages of the invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

DETAILED DESCRIPTION OF THE DRAWINGS

Figure 1:
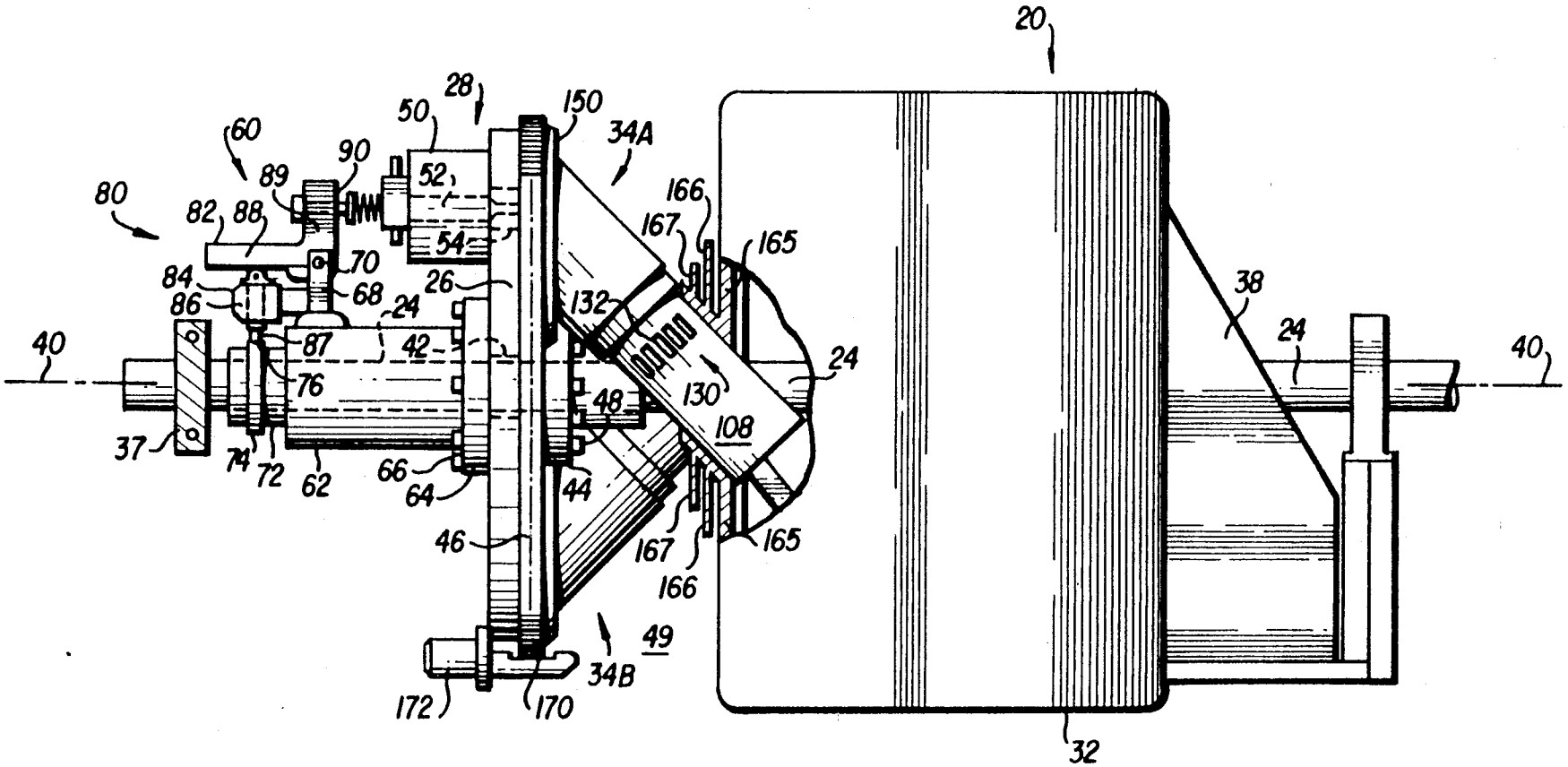
FIG. 1 is a side view of an internal combustion engine according to an embodiment of the invention.
Figure 2:
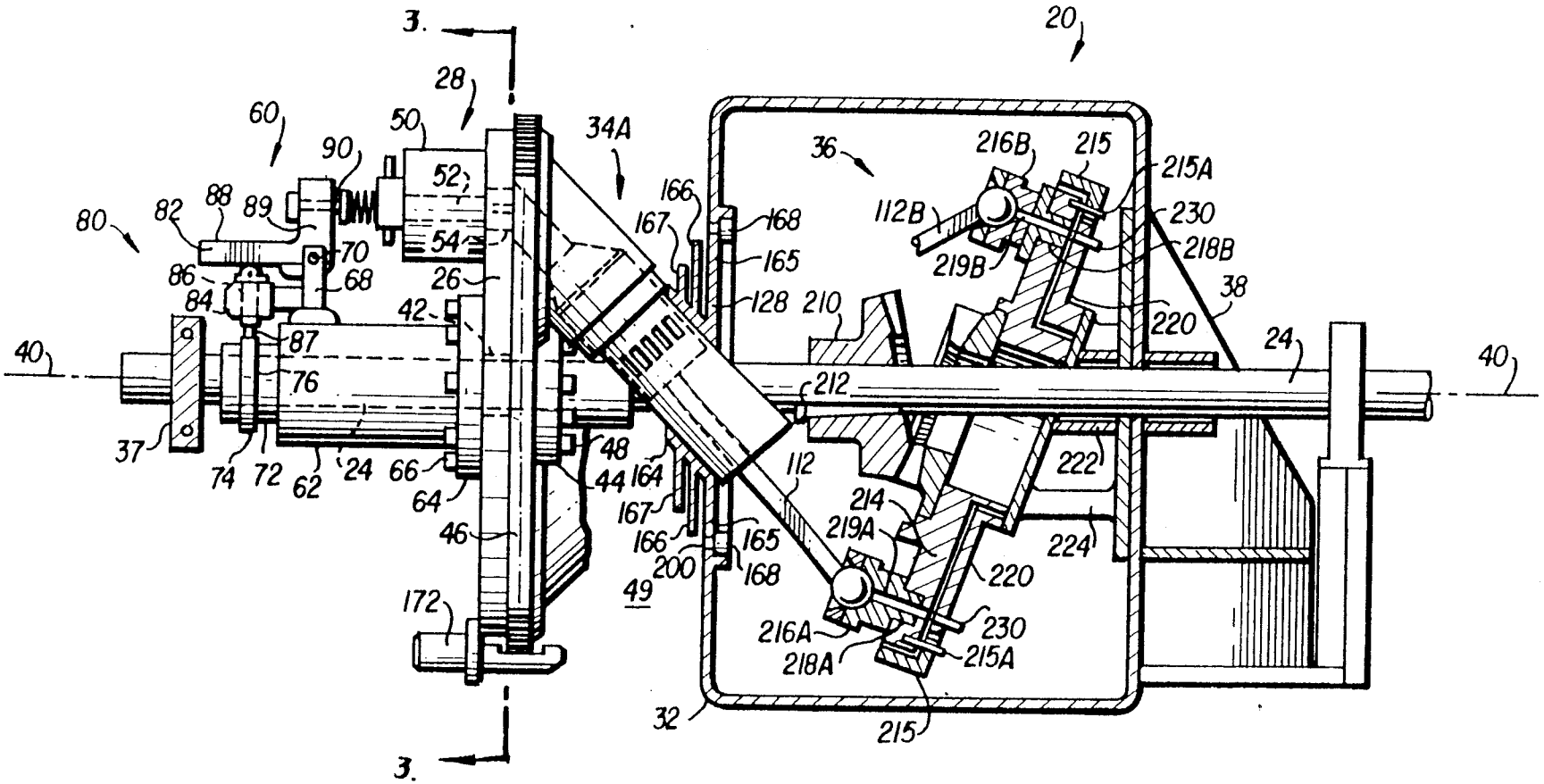
FIG. 2 is a side view, partially sectioned, of the internal combustion engine of the embodiment of FIG. 1.

FIGS. 1 and 2 show a two-stroke cycle, internal combustion engine 20 comprising a rotating drive shaft 24; a stationary reference plate 26; fuel injection means 28 mounted on the reference plate 26; an exhaust aperture 30 formed in the reference plate 26 (see FIG. 3); an oil pan 32; a pair of cylinder assemblies 34A and 34B; and, a wobble plate assembly 36 (see FIG. 2).

The drive shaft 24 is horizontally and rotationally held aloft by front frame member 37 and back frame member 38. The drive shaft 24 rotates about its axis 40. Drive shaft 24 extends through a bearing sleeve 42 provided in the stationary reference plate 26. The drive shaft 24 has an annular collar 44 fixedly mounted thereon. A plate 46, having a diameter approximately that of the stationary reference plate 26, is affixed by fasteners 48 to drive shaft collar 44, so that the plate 46 rotates with the drive shaft 24. The rotating plate 46 is axially positioned along the drive shaft 24 in abutting relationship with the stationary reference plate 26.

The oil pan 32 is fixedly mounted to the back frame member 38 with drive shaft 24 rotatably extending therethrough. Along the axis 40 of the drive shaft 24, the oil pan 32 is spaced apart from the rotating plate 46 so that an essentially cylindrically-shaped, gaseous permeable volume or cavity 49 is formed between the rotating plate 46 and the oil pan 32.

As mentioned above, the stationary reference plate 26 has the fuel injection means 28 mounted thereon and the exhaust aperture 30 formed therein. The fuel injection means 28 includes a housing 50 which accommodates an igniting means, such as fuel injector 52 and an unillustrated glow plug. An igniting end of the fuel injector and glow plug extend through, but not beyond, an axial aperture 54 provided in the stationary reference plate 26. It should be understood that, for other types of internal combustion engines, the igniting means can take other forms, such as a spark plug, for example.

The operation of the fuel injection means 28 is governed by injection timing means 60. As shown in FIGS. 1 and 2, the injection timing means is mounted on the stationary reference plate 26 via a mounting sleeve 62. In this respect, the mounting sleeve 62 has a collar 64 which is affixed to the stationary reference plate 26 by fasteners 66. The drive shaft 24 rotatably extends through an unillustrated central bearing provided in the mounting sleeve 62. A vertical mounting post 68 stands upright on the mounting sleeve 62. The top of the mounting post has two ears between which a pivot pin 70 extends.

The mounting sleeve 62 is locked into position by a locking ring 72 secured to the drive shaft 24. A cam 74 is mounted on the drive shaft 24 alongside the locking ring 72. The cam 74 has one or more timing lobes 76 provided at a point on its periphery.

The injection timing means 60 also includes a cam follower assembly 80. The cam follower assembly 80 comprises an L-shaped pivoting rocker member 82 and a cam plunger assembly 84. The cam follower plunger assembly 84 is horizontally mounted on a side of the upstanding mounting post 68. The cam follower plunger assembly 84 has a vertical aperture therein which slidingly accommodates a cam-following plunger 86.

At its lower end the plunger 86 has a roller 87 which rides upon the timing cam 74 and an upper end upon which the underside of a larger arm 88 of the rocker member 82 rests. The rocker member 82 pivots about the pivot pin 70 carried by the upstanding mounting post 68. A shorter arm 89 of the rocker member 82 carries a horizontally oriented pin 90. As will be seen hereinafter, when the cam 74 rotates to a point that the cam lobe 76 forces the follower plunger 86 upwardly, the plunger 86 in turn causes the rocker member 82 to pivot in the clockwise sense about pivot pin 70, thereby causing the pin 90 to activate the fuel injector 52.

Figure 4:
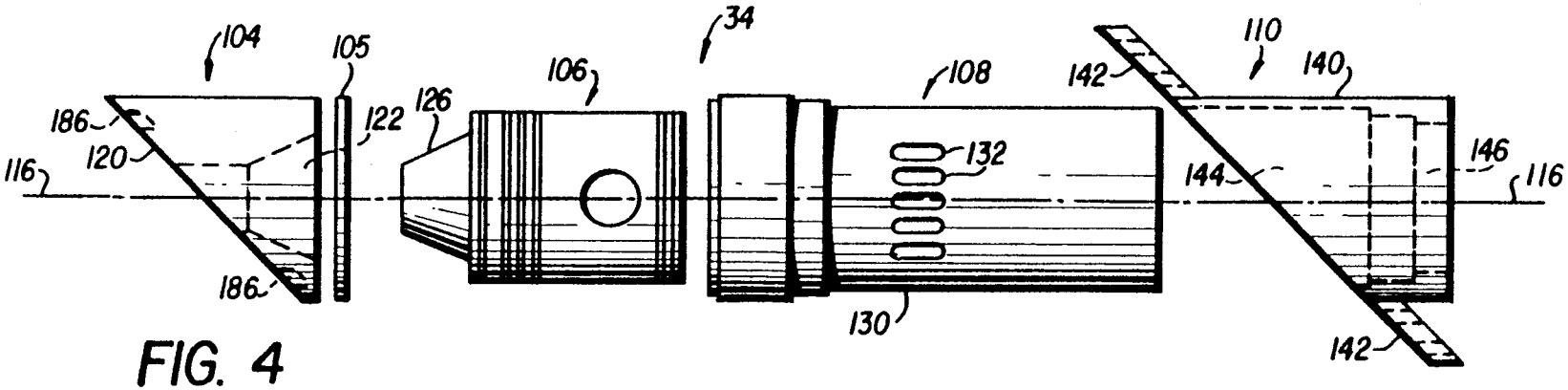
FIG. 4 is an exploded side view of portions of a cylinder assembly (including a piston, a piston liner, and a flange for connecting an end of a piston liner to a rotating plate) of the internal combustion engine of the embodiment of FIG. 1.

One of the cylinder assemblies 34 is shown in the exploded view of FIG. 4. Each cylinder assembly 34 includes a cylinder head 104; a sealing ring 105; a piston 106; a piston liner 10B (also known as a cylinder wall); and, a liner sleeve mount 110 which fits over these parts for orienting and attaching the cylinder assembly 34 to the rotating plate 46.

Figure 7:
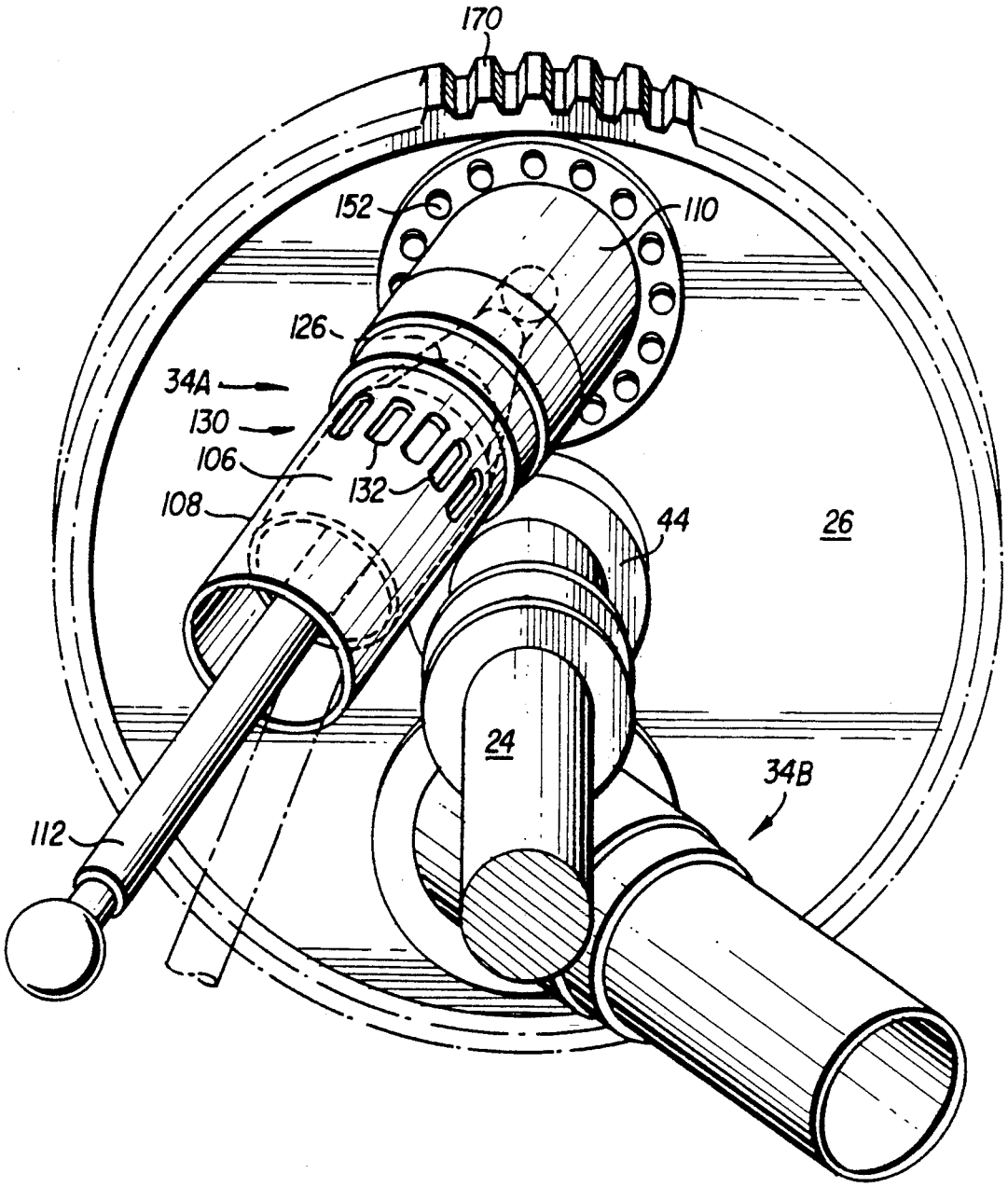
FIG. 7 is a rear view, taken from above, of the cylinder liners and rotating ring gear of the internal combustion engine of the embodiment of FIG. 1.

As understood with reference to FIGS. 2 and 7, the piston 106 has a first end of a piston connecting rod 112 attached thereto in conventional fashion. As will be described hereinafter, a second end of the piston connecting rod 112 is connected to the wobble plate assembly 36 in the confines of the oil pan 32.

When aligned and fitted together, the members of the cylinder assembly 34 (i.e., the cylinder head 104, the sealing ring 105, the piston 106, the piston liner 108, and the liner sleeve mount 110) have a major cylindrical axis 116. When the cylinder assembly 34 is mounted by the liner sleeve mount 110 on the rotating plate 46, the major cylindrical axis 116 of the cylinder assembly 34 is non-parallel with the drive shaft 24.

As shown in FIG. 4, the cylinder head 104 is an essentially cylindrical member having a truncated first end 120. In this respect, cylinder head first end 120 is formed as a plane which intersects the major cylindrical axis 116 at an acute angle on the order of 45 degrees. An annular, semi-conical combustion chamber 122 is internally provided in the cylinder head 104. When the cylinder head 104 is positioned in the liner sleeve mount 110 for attaching the cylinder assembly 34 to the rotating plate 46, the cylinder head first end 120 is positioned proximate the rotating plate 46. In this respect, the cylinder head first end 120 is positioned upon attachment so that the combustion chamber 122 formed therein selectively registers with the igniting aperture 54 and the exhaust aperture 30 in reference plate 26 as the rotating plate 46 rotates about axis 40.

The piston 106 has a nose 126 formed at a first end thereof. The piston nose 126 has the shape of a truncated cone sized for insertion into the conical portion of the combustion chamber 122. The piston connecting rod 112 extends from the second end of the piston 106.

The piston liner 108 is an essentially hollow cylindrical member wherein the piston 106 reciprocates. When assembled, a first end of the piston liner 108 is retained in the liner sleeve mount 110 and a second end of the piston liner 108 fits into an oil pan mounting flange 128.

Figure 5:
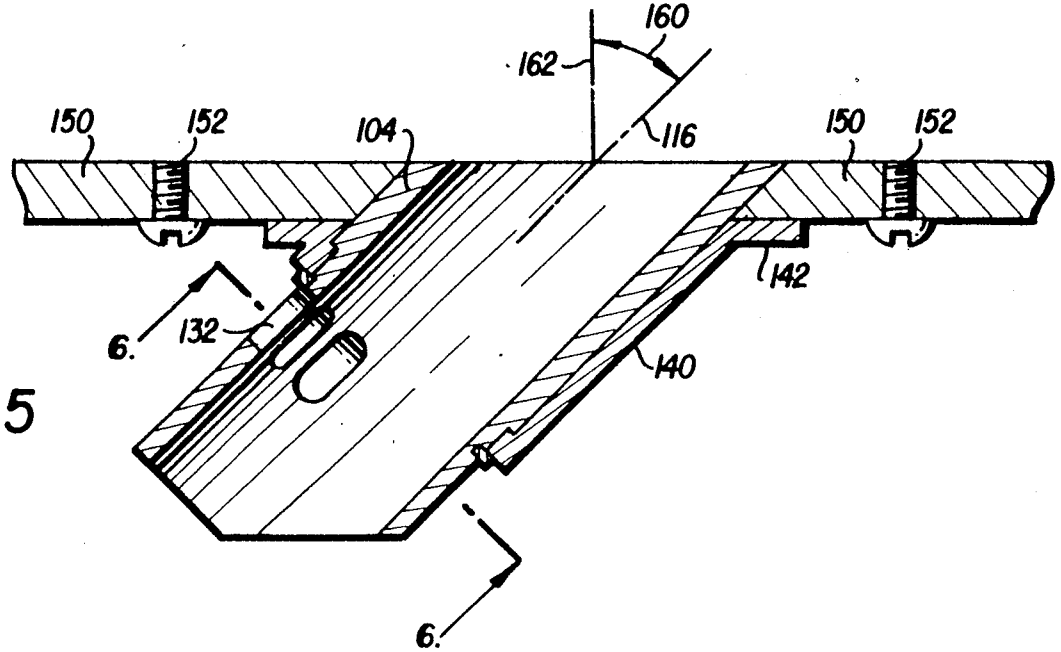
FIG. 5 is a partial sectional side view of a piston liner and liner flange of the internal combustion engine of the embodiment of FIG. 1.
Figure 6:
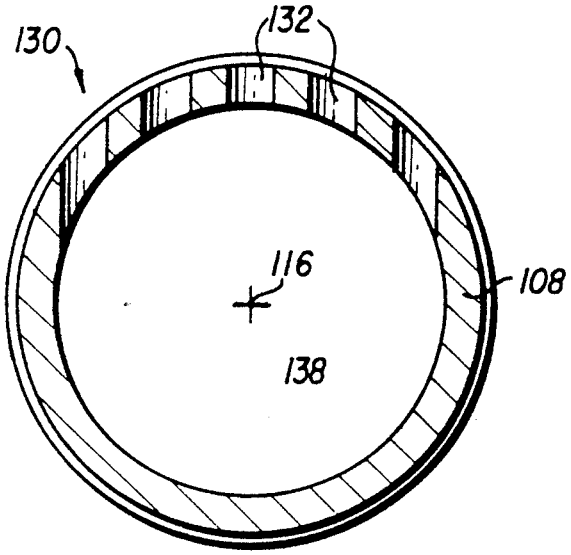
FIG. 6 is a sectional view of a piston liner taken along the line 6—6.

As illustrated in FIGS. 4, 5, and 6, the piston liner 108 has an air intake port 130 provided on its peripheral wall. In the illustrated embodiment, the air intake port 130 comprises five apertures 132 which extend less than about half way around the circumference of the liner peripheral wall. The five apertures 132 comprising the air intake port 130 extend through the liner peripheral wall into the interior 138 of the piston liner 108. However, the five apertures 132 comprising the air intake port 130 do not extend through the opposite half circumference of the piston liner 108. In the illustrated embodiment, the apertures 132 are essentially oval in shape. The major dimension of the oval is on the order of about $\frac{1}{8}$ inch.

The liner sleeve mount 110 which mounts the cylinder assembly 34 to the rotating plate 46 includes a hollow, essentially cylindrical body 140 which is truncated much in the manner as cylinder head 104. That is, the cylindrical body 140 of the liner sleeve mount flange 110 is truncated as by a plane that is inclined at the same acute angle as is formed by cylinder head end 120 with axis 116 (see FIG. 4). The liner sleeve mount 110 has a quasi-annular lip 142 circumferentially formed thereon.

The liner sleeve mount 110 has a hollow mouth 144 which, during assembly, slides over the exterior of the cylinder head 104, the annular sealing ring 105, and the piston liner 108. At the end of the liner sleeve mount 110 which is opposite its lip 142, i.e. opposite its attachment to the rotating plate 46, the interior has a reduced diameter throat portion 146. A first end of the piston liner 108 is secured within this reduced diameter throat portion 146.

The liner sleeve mount 110 fastens the cylinder assembly 34 to the rotating plate 46 via a mounting disc 150. The liner sleeve mount base 150 is secured to the rotating plate 46 by fasteners 152.

The liner sleeve mount 110 internally accommodates the cylinder assembly 34 at such an orientation that the major cylindrical axis 116 of the cylinder assembly 34 is at an angle 160 with respect to line 162 (see FIG. 5). Line 162 is the center line about which the igniting aperture 54 and the exhaust aperture 30 are cyclically registerable with the combustion chamber 122. In addition, line 162 is parallel to the axis 40 of the drive shaft 24. Angle 160 is also equal to the same acute angle formed by the cylinder head 120 with axis 116.

The cylinder assembly 34 is fitted into the liner sleeve mount 110 for attachment to the rotating plate 46 at such an orientation that the intake port 130 provided on the piston liner 108 is located at a rotationally leading portion of the peripheral wall of the liner 108. That is, the apertures 132 of the intake port 130 are angularly oriented about the major cylindrical axis 116 to face the direction of the rotational motion of the cylinder assembly 34 about the axis 40 of the drive shaft 24.

Orienting the apertures 132 of the intake port 130 on the rotationally leading portion of the peripheral wall of the liner 108 in this manner permits the rotational motion of the cylinder assembly 34 about axis 40 to force or scoop ambient air from the cavity 49 into the intake port 130. Thus, the apertures 132 comprising intake port 130 serve as a scoop for forcing ambient air from cavity 49 into the interior of piston liner 108. As mentioned above, the aperture 132 are provided only on one half circumference of the liner 108, lest the air be forced radially completely through the piston liner 108 rather than toward the combustion chamber 122. As will be seen hereinafter, with the combustion chamber 122 registering with the exhaust aperture 30, the rotational motion of the cylinder assembly 34 forces or scoops ambient air from the cavity 49 through the piston liner 108, through the combustion chamber 122, and through the exhaust aperture 30 for scavenging the cylinder assembly 34.

As shown in FIG. 2, the piston liner 108 has a fin sleeve 164 securely fitted thereover at the end of the cylinder assembly 34 which is opposite the cylinder head 104. The fin sleeve 164 includes a base fin 165 and cooling fins 166 and 167. The fins 165, 166, and 167 extend radially from the fin sleeve 164 in a plane which is perpendicular to the axis 40 of the drive shaft 24. Although only three fins are illustrated in FIG. 2, it should be understood that a greater or lesser number of fins can be employed. As will be seen hereinafter, the fin sleeve 164 rotates with the cylinder piston liner 108.

The oil pan 32 is an essentially cylindrically-shaped drum which houses the wobble plate assembly 36. A circular sealing ring 168, provided in a central aperture in the front of the oil pan 32, is biased against the fin sleeve 164, so that ring 168 provides a seal between the rotating fin sleeve 164 and the stationary oil pan 32.

As shown in FIGS. 1 and 7, the outer peripheral surface of the rotating plate 46 has radial teeth 170 regularly spaced therearound. Teeth at the lower course of travel of the rotating plate 46 mesh with teeth of a starter motor 172. The starter motor 172 is mounted at the lower end of the stationary reference plate 26.

The engine 20 of the invention includes first sealing means and second sealing means at the abutment of the stationary reference plate 26 and the rotating plate 46. The first sealing means comprises a pair of concentric, annular sealing rings formed on the stationary reference plate 26, particularly inner sealing ring 180 and outer sealing ring 182. As used herein, "inner" and "outer" descriptions of the sealing rings refer to an inner and an outer radial distance on the stationary reference plate 26 from the axis 40. The sealing rings 180 and 182 are provided in annular grooves formed in the surface of stationary reference plate 46 that abuts the rotating plate 46. Spring biasing means in the form of coiled springs 184 are provided in the grooves beneath the sealing rings to urge the sealing rings 180 and 182 axially outward from the stationary reference plate 26 for contact with the rotating plate 46. In the preferred embodiment, the sealing rings 180 and 182 are ceramic in composition.

The second sealing means comprises an annular combustion chamber sealing ring 186 disposed in the first end 120 of the cylinder head 104 of each of the cylinder assemblies 34. As shown in FIG. 4, the sealing ring 186 encircles the mouth of the combustion chamber 122 of each cylinder assembly 34. The sealing rings 180 and 182 are radially spaced apart along the stationary reference plate 46 so that the exhaust aperture 30 and the igniting aperture 54 are located between the sealing rings 180 and 182, and so that the sealing ring 186 on the cylinder assemblies 34 are located between the sealing rings 180 and 182 as the cylinder assemblies 34 rotate about the axis 40.

Figure 3:
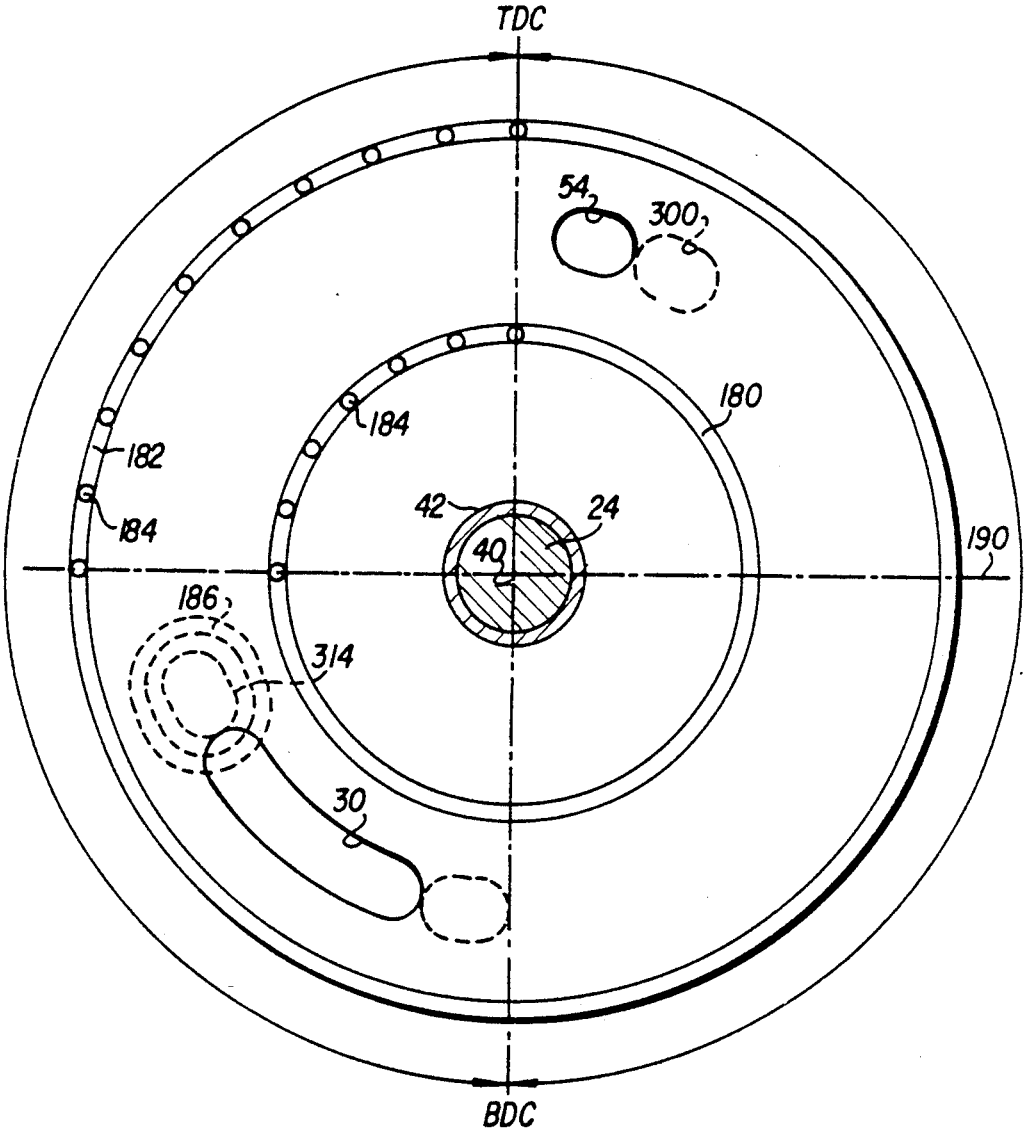
FIG. 3 is a rear front of the internal combustion engine of the embodiment of FIG. 1, taken along line 3—3.

As shown in FIG. 3, the shape of the exhaust aperture 30 provided in the stationary reference plate 26 is that of an elongated oval, with the dimension of elongation being in the angular direction about axis 40. In the particular embodiment of FIG. 3, the exhaust aperture 30 extends through an angle of about 45 degrees with respect to the axis 40. In this respect, if line 190 is taken as being 0 degrees with respect to axis 40, with respect to axis 40 the exhaust aperture 30 extends from about 209 degrees to 255 degrees. With respect to axis 40, the igniting aperture 54 formed in the stationary reference plate 26 extends from about 71.5 degrees to about 85.9 degrees.

Although not shown as such, it should be understood that an exhaust manifold is connected to the exhaust aperture 30 for channeling exhaust gases away from the region of the engine 20.

The wobble plate assembly 36 serves to translate the reciprocating motion of the pistons 106 in the cylinder assemblies 34 into rotational motion. The wobble plate assembly 36 comprises a spider gear 210 centrally mounted and locked to the drive shaft 24 by key 212. In addition, the wobble plate assembly 36 comprises a wobble plate 214 centrally mounted to wobble about the drive shaft 24.

The wobble plate 214 has a retaining ring 215 mounted to its backside by fasteners 215A. The retaining ring 215 also extends around the periphery of the wobble plate 214.

The wobble plate 214 includes two sockets 216A and 216B mounted near the circumference of the wobble plate 214. The sockets 216A and 216B have bearings therein for receiving spherical second ends of the piston connecting rods 112 of the cylinder assemblies 34A and 34B, respectively. The sockets 216A and 216B have milled projections 218A, 218B, respectively, provided thereon for anchoring into the wobble plate 214. The projections 218, as well as the sockets 216, are each provided with a central drilled lubrication channel 219.

The wobble plate assembly 36 further includes a fixed circular plate 220. The fixed circular plate 220 is mounted to the oil pan 32 and to the back frame member 38 by a hollow central sleeve 222 and a plurality of struts 224. A backside of a central portion of the fixed circular plate 220 is mounted to the back frame member 38 so that the plate 220 is inclined at an angle of about 21 degrees with respect to axis 40 of the drive shaft 24.

The fixed circular plate 220 has a slightly smaller diameter than the interior diameter of the retaining ring 215. The wobble plate 214 and peripheral retaining ring 215 mounted thereon fit over a front surface of the fixed circular plate 220 with sufficient tolerance to accommodate rotation and lubrication. In this respect, lubrication fittings 230 are provided on the backside of the fixed circular plate 220 in alignment with the lubrication channels provided in the sockets 216 of the wobble plate 214. Either the back surface of wobble plate 214, the front surface of the fixed circular plate 220, or both are provided with radial and circular grooves to accommodate lubricating fluid applied through the fittings 230. Moreover, either the back surface of wobble plate 214, the front surface of the fixed circular plate 220, or both are formed from Babbitt metal to provide a bearing surface to facilitate smooth rotation of the wobble plate 214 rotates about axis 40 while the circular plate 220 remains stationary.

OPERATION

In the operation of the two-stroke cycle diesel engine 20, during a first stroke the piston 106 travels in the axial direction 116 toward the combustion chamber 122 to compress air (which entered through air intake port 130) into the combustion chamber 122. The travel of the piston 106 and resulting compression of air in combustion chamber 122 occurs as the cylinder assembly 34 rotates (in the counter-clockwise sense as seen in FIG. 3). In particular, during the first stroke the cylinder assembly rotates from about 270 degrees (bottom dead center, "BDC") to about 90 degrees (top dead center, "TDC"). In this respect line 190 of FIG. 3 is taken as being 0 degrees. As the cylinder assembly 34 rotates, the sealing rings 180 and 182 of the first sealing means on the stationary reference plate 26 and the sealing ring 186 on the cylinder head 104 prevent the compressed air from escaping from between the plates 26 and 46.

At about 71.5 degrees of rotation, as shown by broken line 300 in FIG. 3 the combustion chamber 122 of the cylinder assembly 34 begins to register with the igniting aperture 54 formed in the stationary reference plate 26. At 90 degrees (TDC), the lobe 76 on cam 74 forces the follower plunger 86 upwardly against the rocker member 82. The rocker member 82 pivots in a clockwise sense about the pivot pin 70, causing the pin 90 to thereby activate the fuel injector 52. The position of the piston 106 at TDC is represented by line 310 in FIG. 8. The position of the distal or second end of the piston connecting rod 115 at TDC is represented by line 312 in FIG. 8.

Activation of the fuel injector 52 causes the compressed air in the combustion chamber to explode, thereby forcing the piston 106 in a second stroke (power stroke) away from the combustion chamber 122. As the piston 106 is forced to travel away from the combustion chamber, so is the piston connecting rod 112.

The piston 106 travels away from the combustion chamber in the power stroke from about 90.0 degrees to about 270 degrees. At about 209 degrees of rotation, the combustion chamber 122 commences registration and communication with the exhaust aperture 30, as shown by broken line 314 in FIG. 3. The position of the piston 106 at the 209 degree point is represented by line 316 in FIG. 8.

Figure 8:
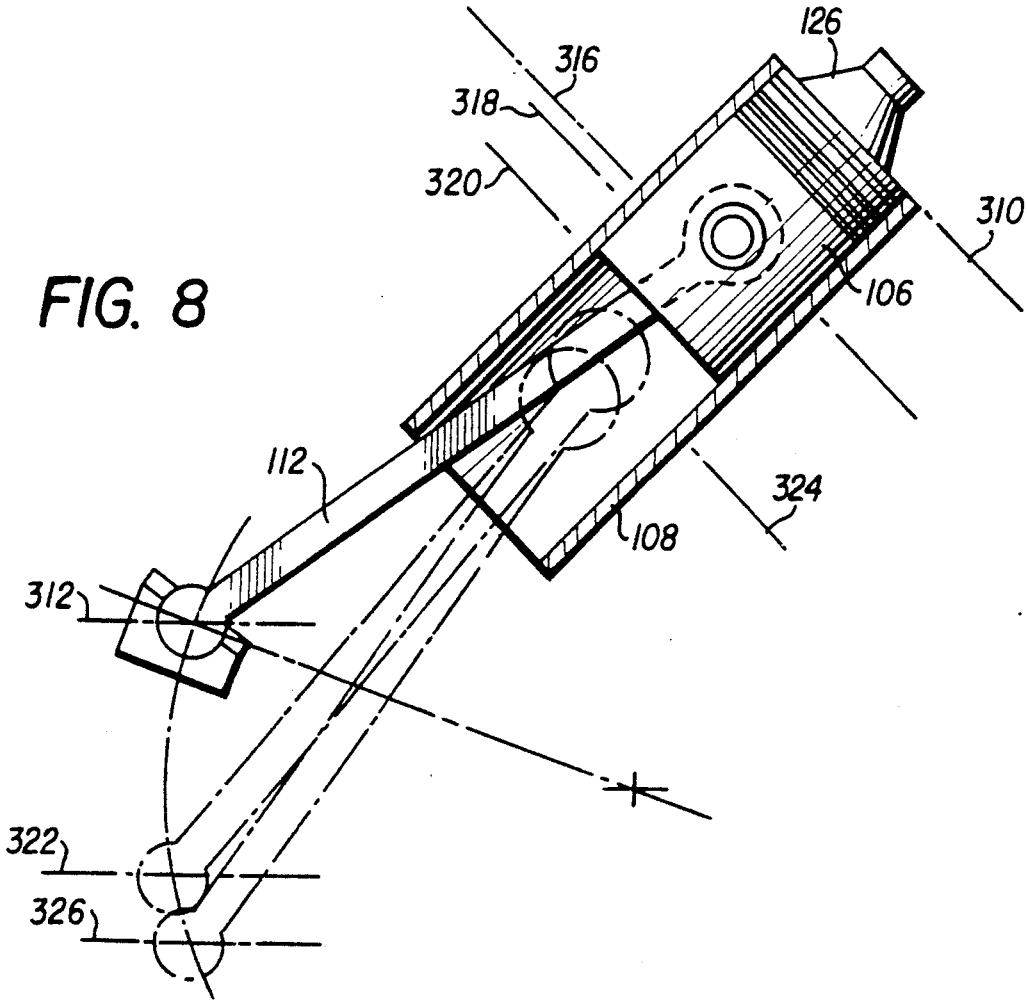
FIG. 8 is a side view, partially sectioned, of portions of a cylinder assembly of the internal combustion engine of the embodiment of FIG. 1.

Just after the 209 degree point, at a point represented by line 318 in FIG. 8, the piston 106 begins to uncover the air intake port 130 which includes the air intake apertures 132. With the combustion chamber 122 registering with the exhaust aperture 30, the rotational motion of the cylinder assembly 34 forces or scoops ambient air from the cavity 49 through the piston liner 108, through the combustion chamber 122, and through the exhaust aperture 30 for scavenging the cylinder assembly 34.

At the point represented by line 320 in FIG. 8, the air intake port 130 is completely uncovered. At this point the position of the second end of the piston connecting rod 115 is represented by line 322 of FIG. 8.

At about 255 degrees of rotation, the combustion chamber 122 ceases registration and communication with the exhaust aperture 30. Subsequently, at BDC, the first stroke (compression stroke) of the cycle is repeated. In FIG. 8, the position of the piston 106 and the second end of the piston connecting rod 115 at BDC are represented by lines 324 and 326, respectively.

Reciprocation of the piston 106 and the piston connecting rod 112 away from the combustion chamber 122 in this manner exerts a angular component of force on the wobble plate 214, thereby causing the wobble plate 214 to rotate about the axis 40. When the piston 106 reaches bottom dead center, the piston connecting rod 112 acquires position shown by rod 112B in FIG. 2 (see also position 326 in FIG. 8), and the central gearing of the wobble plate 214 meshes with the gearing of the spider gear 210 in the manner shown in FIG. 2. The meshing of the gearing of the wobble plate 214 and the spider gear 210 causes the spider gear 210, and the drive shaft 24 keyed thereto, to rotate with the wobble plate 214 about the axis 40. Thus, the linear reciprocation of the piston 106 is translated into rotational motion which is imparted to the drive shaft 24.

Although the operation of just one of the cylinder assemblies 34 has been discussed in the foregoing description of operation of the engine 20, the operation of the other is understood In this respect, while cylinder assembly 34A is experiencing a compression stroke, cylinder assembly 34B is experiencing a power stroke, and vise-versa.

For the engine 20 of the illustrated embodiment, the distance between lines shown in FIG. 8 are as follows: the distance between lines 310 and 316 is 3 and $\frac{7}{8}$ inches; the distance between lines 316 and 318 is $\frac{3}{8}$ inch; and, the distance between lines 318 and 320 is 1 and $\frac{1}{4}$ inches.

Operation of the engine 20 in the foregoing manner does not involve selective registration of air intake ports with manifolds or apertures provided in an engine blocks. Consequently, the engine 20 of the present invention does not require high pressure blowers or turbo chargers to force air through an engine block or manifold and into the cylinders. Rather, rotation of the cylinder assemblies 34 of the engine in ambient air of the substantially unconfined cavity 49 causes the air in cavity 49 to be scooped through the apertures 132 into the piston liner 108. During the exhaust stroke, the ambient air scooped through apertures 132 scavenge the cylinder assembly 34. Moreover, rotation of the cylinder assemblies 34 of the engine 20 in ambient air of the substantially unconfined cavity 49 facilitates cooling of the engine, particularly of the cylinder assemblies 34.

While the invention has been particularly shown and described with reference to the preferred embodiments thereof, it will be understood by those skilled in the art that various alterations in form and detail may be made therein without departing from the spirit and scope of the invention. For example, the invention may be used with internal combustion engines that are not diesel engines. Moreover, more than two cylinder assemblies may be employed.

The embodiments of the invention in which an exclusive property or privilege is claimed are defined as follows:

1. In a two-stroke cycle, internal combustion engine of the type having a plurality of pistons reciprocating within cylinders and having means to translate the reciprocating motion of said pistons into rotary motion, wherein the improvement comprises:

at least two cylinders, said cylinders having a head end and a cylinder wall which defines an interior in which a piston reciprocates;

means for rotating said cylinders about an axis;

stationary fuel injection means for injecting fuel into the head end of said cylinders as said cylinders rotate past said fuel injection means;

a stationary exhaust port located rotationally downstream from said fuel injection means for exhausting gas from the head end of said cylinders; and a plurality of air intake ports, at least one for each cylinder, each port being located through the cylinder wall in a rotationally leading portion of a peripheral wall of said cylinders whereby the rotational motion of the cylinder tends to force air into the interior of the cylinder.

2. The apparatus of claim 1 wherein said intake ports are located in a rotationally leading half circumference of a peripheral wall of said cylinders. of a peripheral wall of said cylinders.

3. The apparatus of claim 1, wherein a plurality of intake ports are provided for each cylinder.

4. The apparatus of claim 1, wherein said cylinders rotate about a drive shaft but axes of pistons in said cylinders are not parallel to the drive shaft.

5. The apparatus of claim 1, wherein said fuel injector means is a single fuel injector.

6. An internal combustion engine comprising:

a rotating drive shaft for rotating in a direction of rotation, said drive shaft having an axis of rotation;

a fixed reference plate having fuel injection means mounted thereon and an exhaust aperture formed therein;

a rotating plate mounted on said rotating drive shaft and being in substantially abutting relationship with said reference plate;

an oil pan mounted on said rotating shaft, said oil pan being spaced apart from said rotating plate along said axis of rotation for defining a cavity between said oil pan and said rotating plate;

a cylinder assembly mounted on said rotating plate and disposed in said cavity between said oil pan and said rotating plate, said cylinder assembly including:

a peripheral cylinder wall for defining a cylindrical volume, said cylinder wall having a first end and a second end, said cylinder wall first end being connected to said rotating plate and said cylinder wall second end being connected to said oil pan;

an intake port provided on a leading peripheral portion of said cylinder wall intermediate said first end and said second end;

a combustion chamber proximate said first end of said cylinder wall, said combustion chamber having an opening in said rotating plate with said opening being alignable upon rotation of said rotating plate with said fuel injection means and said exhaust aperture provided in said reference plate; and, piston means responsive to combustion in said combustion chamber for reciprocating in said cylindrical volume and thereby covering and uncovering said intake port; and, means housed in said oil pan and connected to said piston means and to said rotating drive shaft for translating the reciprocating motion of said piston means into rotational motion of said rotating drive shaft.

7. The apparatus of claim 6, wherein said intake port is located through the cylinder wall at a location which tends to force ambient air from said cavity into the cylinder assembly.

8. The apparatus of claim 7, wherein said intake port is located to receive ambient air from a gaseous permeable region defined by said cavity.

9. The apparatus of claim 6, wherein said intake port is located in a rotationally leading portion of said peripheral wall.

10. The apparatus of claim 9, wherein said intake port is located on a rotationally leading half circumference of said peripheral wall.

11. The apparatus of claim 6, wherein a plurality of intake ports are provided for each cylinder assembly.

12. The apparatus of claim 6, wherein said cylinder assembly rotates about said drive shaft but an axis of piston means is not parallel to the drive shaft.

13. The apparatus of claim 12, wherein a fin sleeve is provided on said cylinder assembly.

14. The apparatus of claim 6, wherein a cam on said drive shaft controls the injection of said fuel injection means.

15. The apparatus of claim 6, wherein a circumference of said rotating plate has teeth provided thereon for engagement by a starter motor.

16. The apparatus of claim 6, wherein one of the plates has concentric circular seals provided thereon whereby positions of alignment of said combustion chamber with said fuel injection means and with said exhaust port occur between the concentric seals.

17. The apparatus of claim 16, wherein said concentric seals are provided on said reference plate.

18. The apparatus of claim 17, wherein said concentric seals are ceramic seals.

19. The apparatus of claim 16, wherein said combustion chamber has an opening surrounded by a combustion chamber seal, the combustion chamber seal abutting said reference plate and being situated between said concentric circular seals.

20. An internal combustion engine comprising:

a rotating drive shaft;

a fixed reference plate having fuel injection means mounted thereon and an exhaust aperture formed therein;

a rotating plate mounted on said rotating drive shaft and being in substantially abutting relationship with said reference plate;

a cylinder assembly mounted on said rotating plate, said cylinder assembly including:

a peripheral cylinder wall for defining a cylindrical volume;

a combustion chamber proximate a first end of said cylinder wall, said combustion chamber having an opening in said rotating plate with said opening being alignable upon rotation of said rotating plate with said fuel injection means and said exhaust aperture provided in said reference plate; and, piston means responsive to combustion in said combustion chamber for reciprocating in said cylindrical volume; and, means connected to said piston means and to said rotating drive shaft for translating the reciprocating motion of said piston means into rotational motion of said rotating drive shaft;

first sealing means carried on one of said plates, said first sealing means being at least two spaced apart circular seals radially disposed on said plate whereby positions of alignment of said combustion chamber opening in said rotating plate and the fuel injection means and exhaust port of the reference plate occur between said spaced apart concentric seals; and second sealing means surrounding said combustion chamber opening in said rotating plate, said second sealing means being situated between said spaced apart concentric circular seals of said first sealing means.

21. The apparatus of claim 20, wherein said concentric seals are provided on said reference plate.

22. The apparatus of claim 20, wherein said first sealing means and said second sealing means are ceramic seals.

23. An internal combustion engine comprising:

a rotating drive shaft for rotating in a direction of rotation, said drive shaft having an axis of rotation;

a fixed reference plate having fuel injection means mounted thereon and an exhaust aperture formed therein;

a rotating plate mounted on said rotating drive shaft and being in substantially abutting relationship with said reference plate;

a cylinder assembly mounted on said rotating plate, said cylinder assembly including:

a peripheral cylinder wall for defining a cylindrical volume, said cylinder wall having a first end and a second end, said cylindrical volume having a major cylindrical axis, said cylindrical axis and said axis of rotation of said drive shaft being non-parallel;

an intake port provided on a rotationally leading peripheral portion of said cylinder wall intermediate said first end and said second end;

a combustion chamber proximate said first end of said cylinder wall, said combustion chamber having an opening in said rotating plate with said opening being alignable upon rotation of said rotating plate with said fuel injection means and said exhaust aperture provided in said reference plate; and piston means responsive to combustion in said combustion chamber for reciprocating in said cylindrical volume and thereby covering and uncovering said intake port; and, means connected to said piston means and to said rotating drive shaft for translating the reciprocating motion of said piston means into rotational motion of said rotating drive shaft.

24. The apparatus of claim 23, wherein said major cylindrical axis of said cylindrical volume is at an angle in a neighborhood of about 45 degrees with respect to the plane of said rotating plate.

25. The apparatus of claim 23, wherein two cylinders assemblies are provided.

26. A method for operating a two-stroke cycle, internal combustion engine of the type having a plurality of pistons reciprocating within cylinders and having means to translate the reciprocating motion of said pistons into rotary motion, said method comprising:

rotating said cylinder of said engine past stationary fuel injection means;

injecting a fuel charge into a head end of each of said cylinder as it passes said fuel injection means;

igniting said fuel charge and allowing it to expand within said cylinder, thereby causing the piston within said cylinder to move away from said cylinder head;

rotating said cylinder past a stationary exhaust port, said exhaust port and said head end of said cylinder coming into alignment before the piston within said cylinder reaches its extreme point of travel away form said cylinder head end;

causing the rotational motion of said cylinder to force air into an air intake port provided on a rotationally leading portion of a wall of said cylinder at a location where said port is uncovered by said piston after said exhaust port and cylinder head end are in alignment, but before the piston reaches its extreme point of travel away from said cylinder head end.

27. A method for scavenging combustion gases from the cylinders of a two-stroke cycle, internal combustion engine, said method comprising:

opening an exhaust port at a head end of said cylinder before the piston within said cylinder reaches its extreme point of travel away from said cylinder head end;

rotating said cylinder in a cavity having a substantially unconfined atmosphere;

opening an air entry port after said exhaust port has been opened but before said piston reaches its extreme point of travel, said air entry port being provided in a wall of said cylinder, said air entry port being located on a rotationally leading peripheral portion of said cylinder wall; and, causing the rotational motion of said cylinder to force air into said air intake port and to flush exhaust gases out of said cylinder through said exhaust port.

* * * * *